US008858237B2

(12) United States Patent
Hsu et al.

(10) Patent No.: US 8,858,237 B2
(45) Date of Patent: Oct. 14, 2014

(54) RECEPTACLE CONNECTOR HAVING IMPROVED CONTACT MODULES

(75) Inventors: Chun-Hsiung Hsu, New Taipei (TW); Ji-Feng Qiu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 181 days.

(21) Appl. No.: 13/525,638

(22) Filed: Jun. 18, 2012

(65) Prior Publication Data

US 2012/0322313 A1 Dec. 20, 2012

(30) Foreign Application Priority Data

Jun. 16, 2011 (CN) ..... 2011 1 0162322

(51) Int. Cl.
*H01R 9/00* (2006.01)

(52) U.S. Cl.
USPC ..... 439/60; 439/637

(58) Field of Classification Search
USPC ..... 439/637, 60
See application file for complete search history.

(56) References Cited

U.S. PATENT DOCUMENTS

| | | | | |
|---|---|---|---|---|
| 5,425,651 | A * | 6/1995 | Thrush et al. | 439/326 |
| 5,730,609 | A | 3/1998 | Harwath | |
| 5,775,938 | A * | 7/1998 | Noro et al. | 439/495 |
| 6,203,328 | B1 * | 3/2001 | Ortega et al. | 439/60 |
| 7,198,519 | B2 * | 4/2007 | Regnier et al. | 439/637 |
| 7,798,820 | B2 | 9/2010 | Hong | |
| 7,833,058 | B2 * | 11/2010 | Zhang et al. | 439/607.41 |
| 8,292,669 | B2 * | 10/2012 | Wang et al. | 439/637 |
| 8,353,707 | B2 * | 1/2013 | Wang et al. | 439/60 |
| 8,353,728 | B2 * | 1/2013 | Wang et al. | 439/637 |
| 2004/0072467 | A1 * | 4/2004 | Jordan et al. | 439/492 |
| 2012/0040569 | A1 | 2/2012 | Wang | |
| 2012/0322313 | A1 * | 12/2012 | Hsu et al. | 439/629 |
| 2013/0309906 | A1 * | 11/2013 | De Geest, Jan | 439/607.31 |

* cited by examiner

*Primary Examiner* — Neil Abrams
(74) *Attorney, Agent, or Firm* — Ming Chieh Chang; Wei Te Chung

(57) ABSTRACT

A receptacle connector (100) includes a housing (10), a front contact module (30) and a rear contact module (20) assembled in the housing. The housing has a cavity (12) opening along a horizontal direction. The cavity has a top wall (121) and a bottom wall (122) opposing to each other, the bottom wall having a tongue portion (120) at a front side of the housing. The rear contact module has a first contacts (22) and a second contacts (23) positioned on the top wall and the bottom wall respectively. The front contact module includes a one-piece insulator (31) assembled to a bottom side (13) of the housing, and a number of third contacts (32) insert-molded with the insulator.

19 Claims, 8 Drawing Sheets

RECEPTACLE CONNECTOR HAVING IMPROVED CONTACT MODULES

BACKGROUND OF THE INVENTION

1. Field of the Invention

The present invention relates to a receptacle connector, and more particularly to a SFP (Small Form-factor Pluggable) receptacle connector.

2. Description of Related Art

U.S. Patent Application Publication No. 2012/0040569 published on Feb. 16, 2012 discloses an electrical connector assembly including a receptacle connector. The receptacle connector has a housing, a row of first contact modules and a row of second contact modules assembled therein. Each of the first contact modules comprises a first insulative wafer, a first contact and a second contact insert-molded with the first insulative wafer. Each of the second contact modules comprises a second insulative wafer and a third contact insert-molded with the second insulative wafer. The insulative wafers of the second contact modules are first stacked together and then inserted as a whole into a mounting slot on the bottom side of the housing. The third contact extends forwardly and upwardly along a mating direction and the mounting slot has a corresponding forwardly and upwardly space to receive the third contact.

A receptacle connector having an improved terminal module is desired.

SUMMARY OF THE INVENTION

Accordingly, an object of the present invention is to provide a receptacle connector having a contact module with a improved configuration. The contact module could be assembled into the receptacle connector quickly and reliably.

In order to achieve the object set forth, a receptacle connector in accordance with the present invention includes a housing, a front contact module and a rear contact module assembled in the housing. The housing has a cavity opening along a horizontal direction. The cavity has a top wall and a bottom wall opposing to each other. The bottom wall has a tongue portion at a front side of the housing. The rear contact module is disposed in the back side of the housing. The rear contact module includes a plurality of first contacts and second contacts. Each of the contacts has a mating portion, a mounting portion, and a body portion interconnecting the mating portion and the mounting portion. The mating portions of the first contacts and the second contacts are respectively exposed on the top wall and the bottom wall into the cavity. The mounting portions of the first contacts and the second contacts extend out of the bottom wall. The front contact module includes a one-piece insulator and a plurality of third contacts insert-molded with the one-piece insulator. The insulator is assembled to the bottom wall. The third contact has a body portion extending forwardly from the insulator beyond the tongue portion of the bottom wall, and a mating portion continuing the body portion to extend upwardly and rearwardly over the tongue portion.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
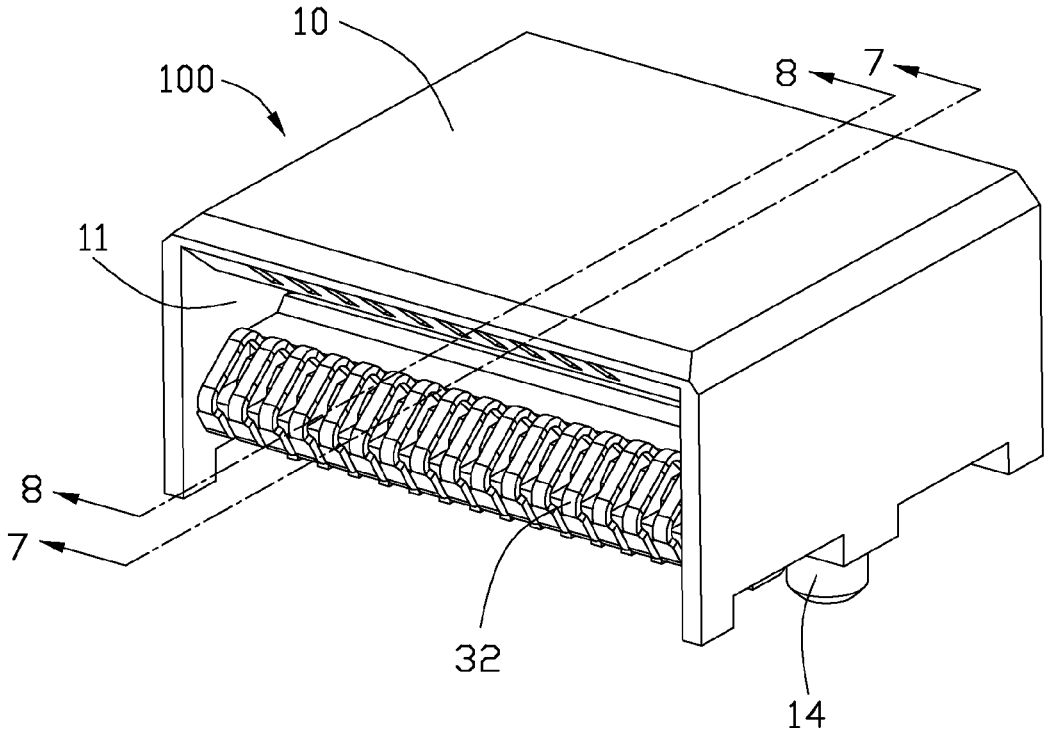
FIG. 1 is an assembled perspective view showing a receptacle connector in accordance with the present invention.
Figure 2:
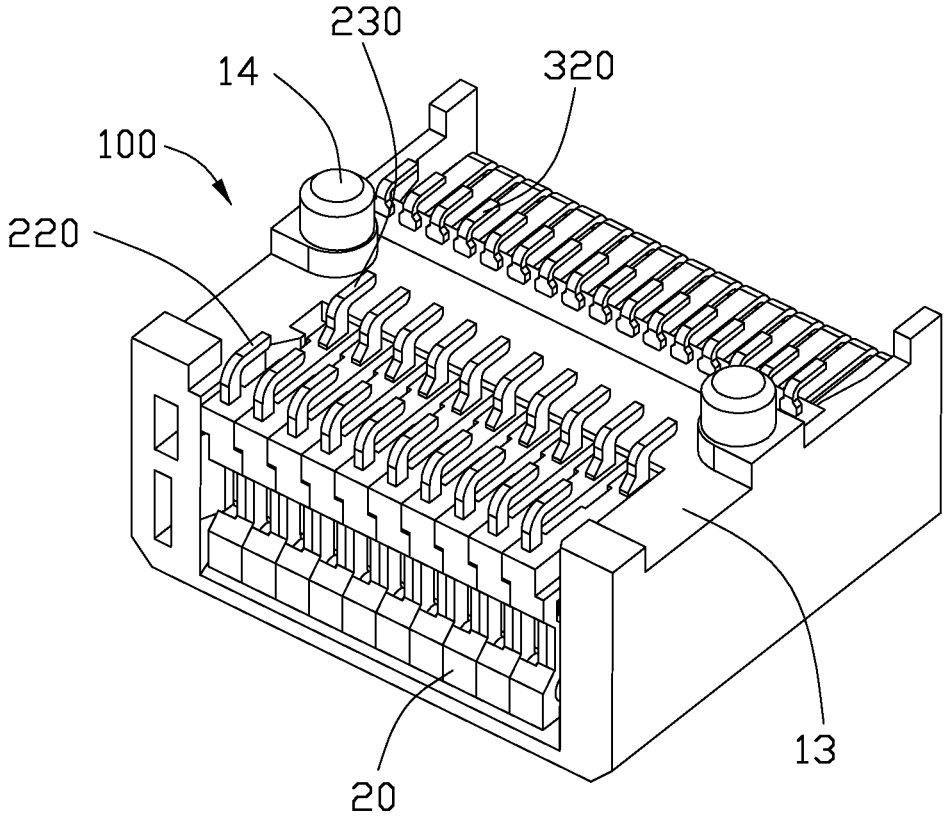
FIG. 2 is another assembled perspective view of the receptacle connector as shown in FIG. 1.

Reference will now be made to the drawing figures to describe the present invention in detail.

Referring to FIGS. 1 to 4, a receptacle connector 100 in accordance with the present invention includes a housing 10, a front contact module 30 and a rear contact module 20 respectively received in the housing 10. The receptacle connector 100 is adapted to be mounted onto a first board (not shown), and configured for receiving a second board from a plug connector (not shown).

Referring to FIGS. 5 to 8, the housing 10 has a cavity 12 with an opening 11 at a front side of the housing 10, the opening 11 configured for receiving the second board (not shown) along a horizontal direction. The cavity 12 has a top wall 121 and a bottom wall 122 opposing to each other. The bottom wall 122 has a tongue portion 120 adjacent to the opening 11 at the front of the housing 10. The housing 10 defines a plurality of edge grooves 15 on the tongue portion 120 of the bottom wall 122, each of the edge grooves 15 opening forwardly and upwardly. The cavity 12 has a plurality of inner grooves 15' on the bottom wall 122, and a plurality of inner grooves 15" on the top wall 121. These inner grooves 15', 15" are configured for extending into the housing 10 and opening towards the cavity 12. The housing 10 further has at least one mounting recess 110 under the cavity 12 for mounting the front contact module 30. The housing 10 has a bottom side 13 and a mounting post 14 adapted to be positioned into the first board (not shown).

Figure 3:
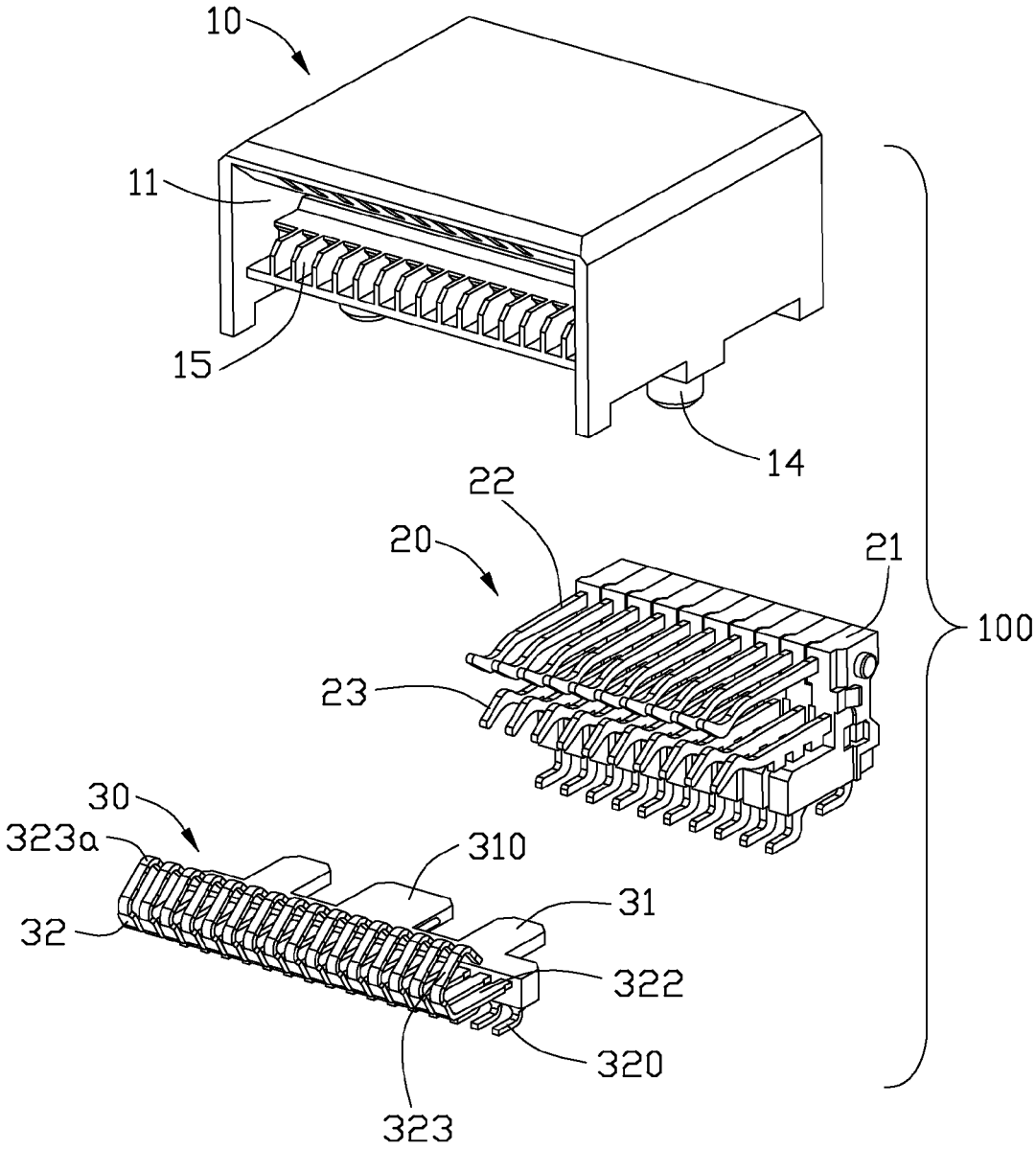
FIG. 3 is a partially exploded perspective view of the receptacle connector as shown in FIG. 1.
Figure 4:
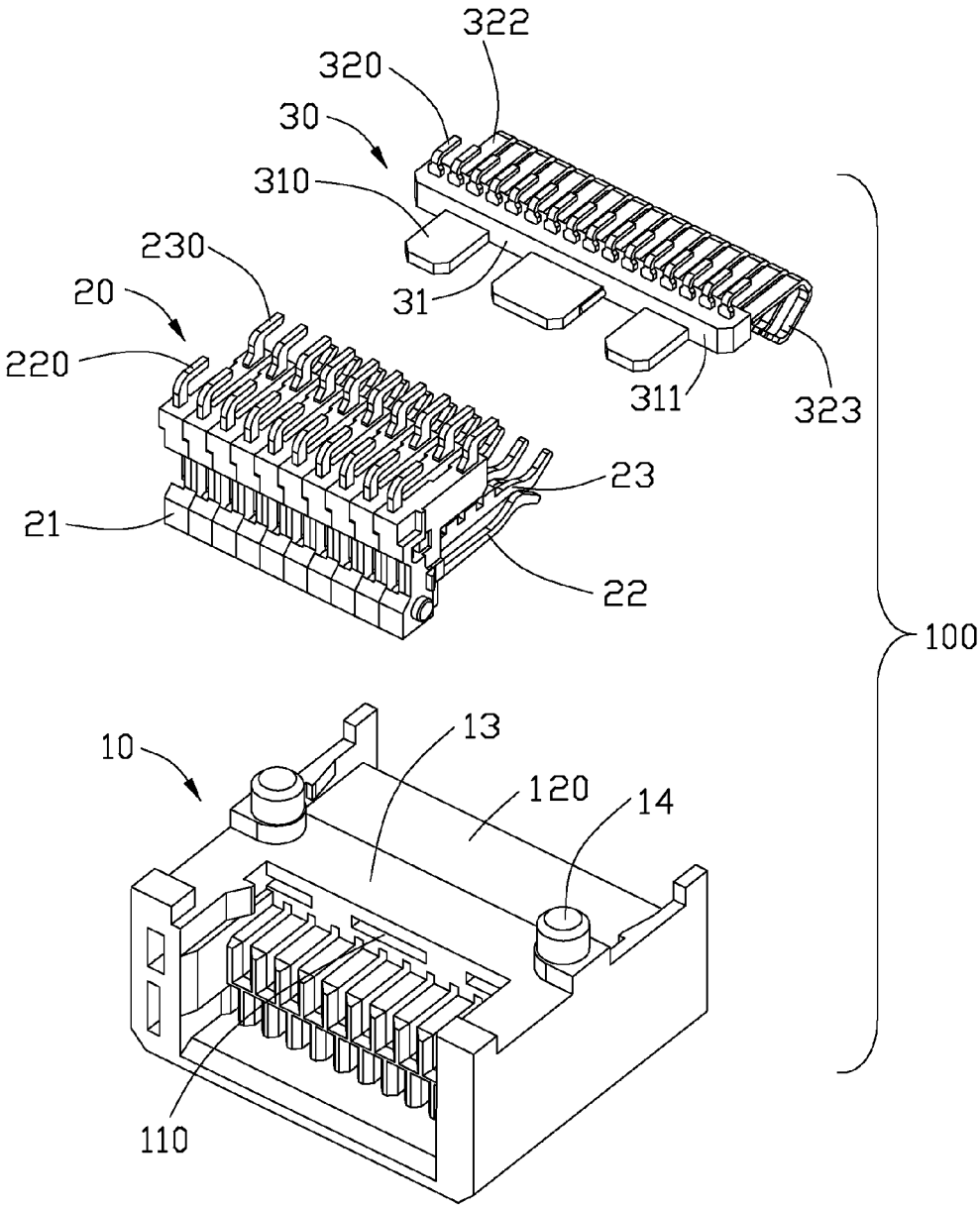
FIG. 4 is another partially exploded perspective view of the receptacle connector as shown in FIG. 3.
Figure 5:
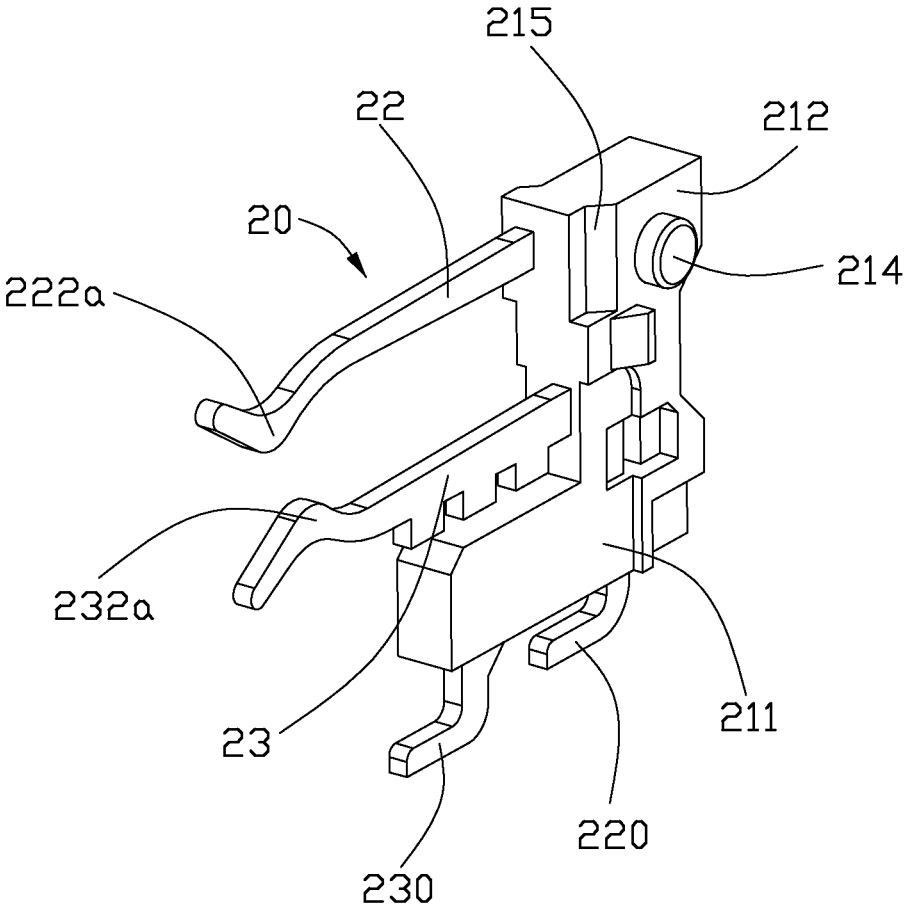
FIG. 5 is an assembled perspective view showing the rear contact module as shown in FIG. 3.
Figure 6:
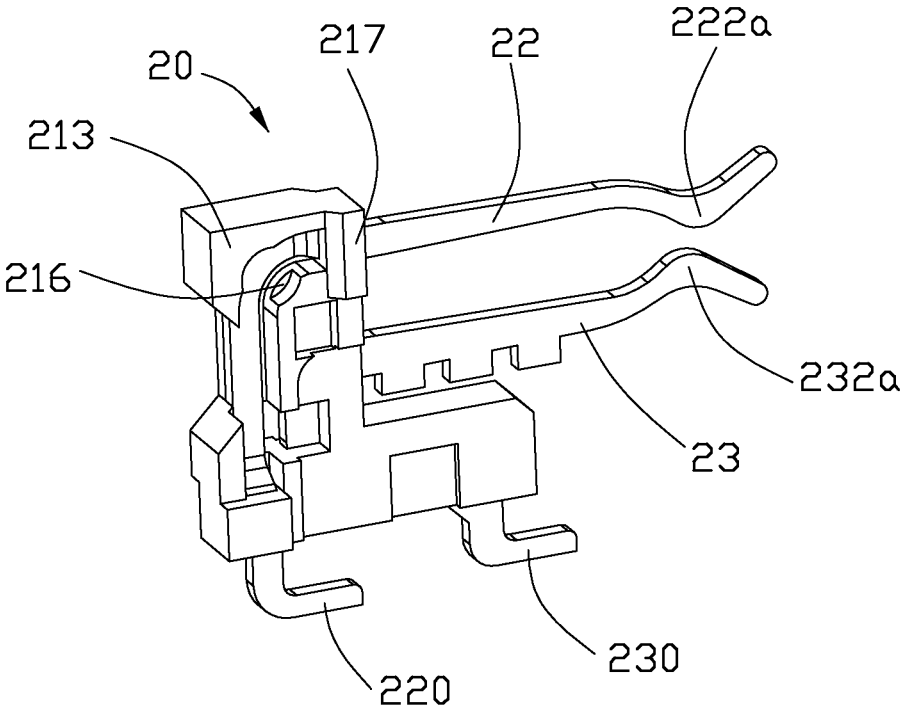
FIG. 6 is another assembled perspective view of the rear contact module as shown in FIG. 5.
Figure 7:
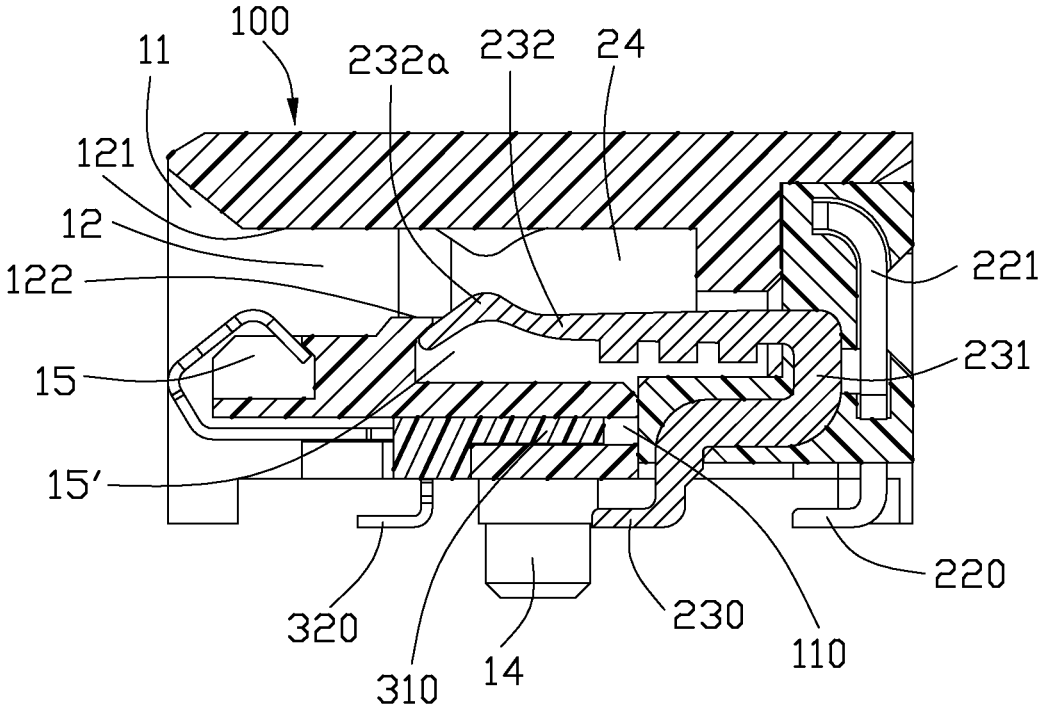
FIG. 7 is a cross-sectional view showing the receptacle connector, taken along line 7-7 of FIG. 1.
Figure 8:
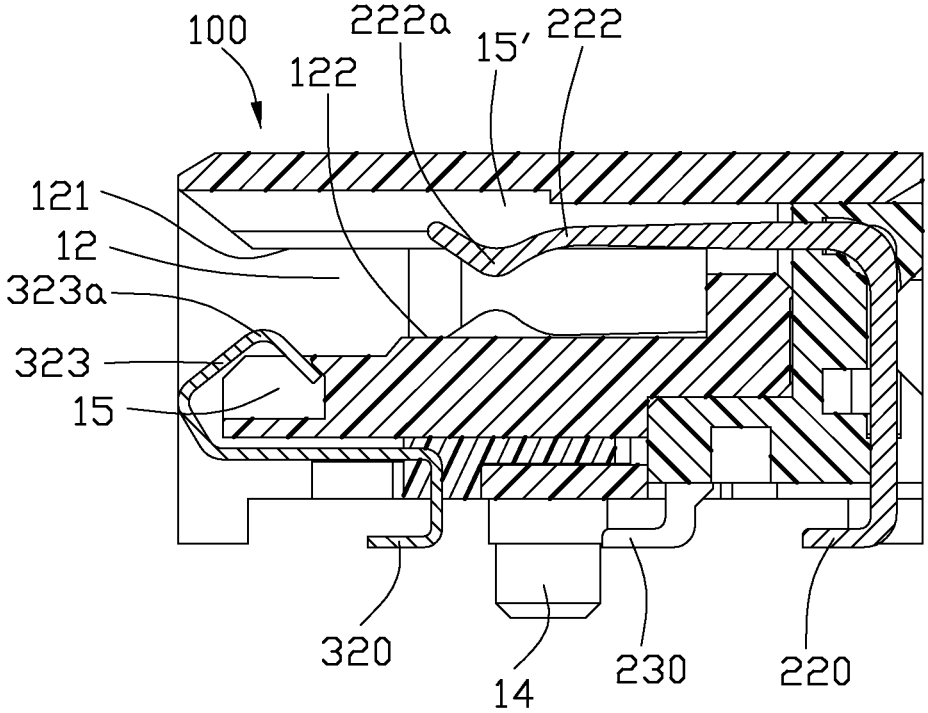
FIG. 8 is a cross-sectional view showing the receptacle connector, taken along line 8-8 of FIG. 1.

Referring to FIGS. 3 and 4, the front contact module 30 comprises a one-piece insulator 31 and a plurality of third contacts 32. The third contact 32 has a mounting portion 320, a mating portion 323 and a body portion 322 interconnecting the mounting portion 320 and the mating portion 323. At least a part of the body portion 322 of each of the third contacts 32 is molded into the insulator 31 along a transversely direction. The insulator 31 has a base portion 311 and at least one mounting protrusion 310 backwardly extending from the base portion 311. The body portion 322 of the third contact 32 extends forwardly from the base portion 311 of the insulator 31 under the bottom wall 122. The body portion 322 of the third contact 32 further extends beyond the tongue portion 120 and bends backwardly and upwardly for connecting the mating portion 323 above the tongue portion 120. The mounting protrusion 310 is adapted to be received into the mounting recess 110. Thus, the front contact module 30 could be assembled into the housing 10 by inserting the mounting protrusion 310 into the mounting recess 110 along a front-to-back direction.

The body portion 322 of the third contact 32 forwardly extends out of the base portion 311 of the insulator 31. Thus, the mating portion 323 is assembled to the housing 10 in cantilever state. The mating portion 323 has a mating flange 323*a* extending from the mating portion 323 towards the cavity 12. The mating flanges 323*a* are configured for elastically mating with the contacts on a bottom side of the second board (not shown). The mating flanges 323*a* is adapted to be received in the edge grooves 15 respectively.

In conjunction with FIGS. 3 to 8, the rear contact module 20 is assembled to the housing 10 along a back-to-front direction. The rear contact module 20 includes a plurality of insulative wafers 21, a row of first contacts 22 and a row of second contacts 23. Each of the first contacts 22 has a mounting portion 220, a mating portion 222 and a body portion 221 interconnecting the mounting portion 220 and the mating portion 222. Each of the second contacts 23 has a mounting portion 230, a mating portion 232 and a body portion 231 interconnecting the mounting portion 230 and the mating portion 232. The body portion 221 of the first contacts 22 and the body portion 231 of the second contacts 23 are insert-molded into the wafer 21 to form a pair of contacts. The first contact 22 and the second contact 23 offset with each other by a row pitch along a transversely direction in the wafer 21. Both of the mounting portions 220 of the first contacts 22 and the second contacts 23 extend out of the bottom wall 122 adapted to be mounted to the first board (not shown).

Each of the wafers 21 has a protrusion 214 on a first side 212 and an aperture 216 on a second side 213 parallel the first side 212, the wafers 21 transversely coupled together by inserting the protrusion 214 from one wafer 21 into the aperture 216 on another adjacent wafer 21.

Both of the mating portion 222 of the first contact 22 and the mating portion 232 of the second contact 23 are assembled to the wafer 21 in cantilever state. The mating portion 222 has a mating flange 222*a* extending from the mating portion 222 towards the cavity 12. The mating portion 232 has a mating flange 232*a* extending from the mating portion 232 towards the cavity 12. The mating flanges 222*a* are received in the inner grooves 15". The mating flanges 232*a* are received in the inner grooves 15'. The mating flanges 222*a* of the first contacts 22 are configured for elastically mating with a top surface of the second board (not shown). The mating flanges 232*a* of the second contacts 22 are configured for elastically mating with a bottom surface of the second board (not shown).

Both the mating portions 232 of the second contacts 23 and mating portions 323 of the third contacts 32 are positioned at the bottom wall 122 of the cavity 12. In the preferred embodiment, the mating flanges 323*a* of the third contacts 32 is lower than the mating flanges 232*a* of the second contacts 23. The mating flanges 323*a* of the third contacts 32 is positioned between the mating flanges 232*a* of the second contacts 23 and the opening 11.

The third contacts 32 are insert-molded together in the front contact module 30, which could be assembled to the housing 10 quickly and reliably, even though the second contacts 22 and the third contacts 23 could be assembled to the housing 10 separately in another embodiment. In the preferred embodiment, the mounting portion 320 of the third contacts 32, the mounting portion 230 of the second contacts and the mounting portion 220 of the first contacts are positioned in a horizontal surface parallel the first board (not shown) so as to be soldered conveniently.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle connector comprising:

a housing having a cavity opening along a horizontal direction, said cavity having a top wall and a bottom wall opposing to each other;

a row of first contacts and a row of second contacts, each of the first contacts and second contacts having a mating portion, a mounting portion, and a body portion interconnecting the mating portion and the mounting portion, the mating portions of the first contacts and the second contacts respectively exposed on the top wall and the bottom wall into the cavity, the mounting portions of the first contacts and the second contacts extending out of the bottom wall; and a front contact module including a one-piece insulator and a plurality of third contacts insert-molded with the one-piece insulator, the insulator being mounted to the bottom wall, each said third contact having a mating portion at least partially extending into the cavity;

the bottom wall has a tongue portion and a plurality of edge grooves defined on the tongue portion, each of the edge grooves opening forwardly and upwardly and receiving the mating portion of the third contact.

2. The receptacle connector as claimed in claim 1, further including a rear contact module disposed in the housing, and wherein the rear contact module comprises a plurality of wafers each insert-molded with an associated first contact and an associated second contact.

3. The receptacle connector as claimed in claim 2, wherein each of the wafers has a protrusion on a first side and an aperture on an opposite second side, the wafers transversely coupled together by inserting the protrusion from one wafer into the aperture on another adjacent wafer.

4. The receptacle connector as claimed in claim 1, wherein each of the third contacts has a body portion fixed by the insulator, and a mounting portion extending downwardly from a rear end of the body portion and exposed under the bottom wall, the mating portion of the third contact extending upwardly from a front end of the body portion and continuously extending rearwardly.

5. The receptacle connector as claimed in claim 1, wherein the row of first contacts and the row of second contacts offset with respect to each other by a row pitch along a transverse direction.

6. The receptacle connector as claimed in claim 1, wherein each of the mating portions of the first, the second and the third contacts has a mating flange extending inwardly from the mating portion towards the cavity.

7. The receptacle connector as claimed in claim 6, wherein the mating flanges of the third contacts is at a level lower than that of the mating flanges of the second contacts.

8. The receptacle connector as claimed in claim 1, wherein the top wall has a plurality of upper inner grooves opening toward the cavity and receiving the mating portions of the first contacts, and the bottom wall has a plurality of lower inner grooves opening toward the cavity and receiving the mating portions of the second contacts.

9. The receptacle connector as claimed in claim 1, wherein the insulator has at least one mounting protrusion, and the housing has at least one mounting recess receiving the at least one mounting protrusion.

10. The receptacle connector for receiving a printed circuit board, comprising:

a housing defining opposite upper and bottom walls with therebetween in a vertical direction a cavity forwardly communication with an exterior in a front-to-back direction perpendicular to said vertical direction;

a plurality of upper passageways formed in the upper wall along the front-to-back direction;

a plurality of front lower passageways formed in a front portion of the bottom wall;

a plurality of rear lower passageways formed in a rear portion of the bottom wall;

a front contact module integrating a plurality of lower front contacts with contacting sections of the lower front contacts being deflectable in the front lower passageways in said vertical direction, respectively;

a rear contact module integrating a plurality of upper contacts and a plurality of lower rear contacts with contacting sections of the upper contacts being deflectable in the upper passageways in the vertical direction, respectively, and further with contacting sections of the lower rear contacts being deflectable in the rear lower passageways in the vertical direction, respectively.

11. The receptacle connector as claimed in claim 10, wherein the housing is configured to allow the front contact module to be rearwardly assembled thereto in the front-to-back direction while allowing the rear contact module to be forwardly assembled thereto along the front-to-back direction.

12. The receptacle connector as claimed in claim 10, wherein all tails of said upper contacts, the front lower contacts and the rear lower contacts horizontally forwardly extend under the housing without extending beyond a contour of said housing.

13. The receptacle connector as claimed in claim 10, wherein the upper wall defines a downwardly oblique guiding face for downwardly guiding the printed circuit board into the cavity while the front lower contact define an upwardly oblique guiding face for upwardly guiding the printed circuit board into the cavity.

14. The receptacle connector as claimed in claim 13, wherein the contacting section of the front lower contact is provided by thereof a bending face which is perpendicular to a corresponding thickness of said front lower contact while the contacting section of the upper contact and that of the lower rear contact are provided by a thickness face thereof by reason that the upper contacts and the rear lower contacts are directly formed by stamping without forming.

15. The receptacle connector as claimed in claim 14, wherein one of the contacting section of the upper contact and that of the lower rear contact is provided with a teeth structure.

16. A receptacle connector for receiving a printed circuit board, comprising:

a housing defining opposite upper and bottom walls with therebetween in a vertical direction a cavity forwardly communication with an exterior in a front-to-back direction perpendicular to said vertical direction;

a plurality of upper passageways formed in the upper wall along the front-to-back direction;

a plurality of rear lower passageways formed in a rear portion of the bottom wall, said upper passageways being not aligned with the corresponding rear lower passageways but cooperating with said rear lower passageways to be alternately arranged with each other along a transverse direction perpendicular to both said front-to-back direction and said vertical direction; and a rear contact module integrating a plurality of upper contacts and a plurality of lower rear contacts with contacting sections of the upper contacts being deflectable in the upper passageways in the vertical direction, respectively, and further with contacting sections of the lower rear contacts being deflectable in the rear lower passageways in the vertical direction, respectively; wherein both the upper contacts and the rear lower contacts are directly formed by stamping without forming, and said upper contacts and said rear lower contacts are arranged with pairs under condition that in each pair a middle retention portion of the upper contact are coplanar with the whole rear lower contact while in the upper contact there is an offset between the contacting section and the middle retention portion for allowing the contacting section to be received in the corresponding upper passageway which is offset from the corresponding rear lower passageway in the transverse direction.

17. The receptacle connector as claimed in claim 16, wherein in the upper contact there is another offset between the middle retention section and a tail section so as to have tails of the rear lower contacts and those of the upper contacts are staggered with each other along the transverse direction.

18. The receptacle connector as claimed in claim 17, wherein said the rear contact module is composed of a plurality of wafers, of which each integrates one pair of said upper contact and said rear lower contact therein, stacked with one another along the transverse direction in a zigzag manner not only to comply with offset structures of the corresponding upper contact but also to enhance mutual engagement between every two neighboring rear contact modules.

19. The receptacle connector as claimed in claim 18, further including a front contact module integrating a plurality of front lower contacts with corresponding contacting sections moveable around the bottom wall, wherein the housing is configured to allow the rear contact module to be forwardly assembled thereinto in the front-to-back direction while allowing the front contact module rearwardly assembly to be assembled thereinto in the front-to-back direction.

* * * * *